United States Patent [19]

Baumann

[11] 3,970,344

[45] July 20, 1976

[54] OXYGEN TANK HOLDER FOR WHEELCHAIRS

[76] Inventor: Arthur V. Baumann, 1410 Wynneburne Drive, Cincinnati, Ohio 45238

[22] Filed: Dec. 11, 1975

[21] Appl. No.: 639,833

[52] U.S. Cl. ..... 297/189; 248/311.1; 297/DIG. 4

[51] Int. Cl.[2] ..... A47C 7/62

[58] Field of Search ..... 248/311; 297/189, 191, 297/188, DIG. 4, 217, 42, 45; 280/242 WC

[56] References Cited

UNITED STATES PATENTS

| | | | |
|---|---|---|---|
| 2,313,944 | 3/1943 | Keener et al. | 248/311 R X |
| 3,054,638 | 9/1962 | Johnson et al. | 297/188 X |
| 3,709,556 | 1/1973 | Allard | 297/188 |
| 3,891,268 | 6/1975 | Taylor | 297/188 X |

*Primary Examiner*—J. Franklin Foss
*Attorney, Agent, or Firm*—Walter S. Murray

[57] ABSTRACT

An oxygen tank holding device for ready attachment to most standard, foldable wheelchairs. The device is collapsible and includes a tank receiving basket and a pair of struts detachably supported on the wheelchair and pivotally connected to opposed sides of the basket; flexible cable means being provided to maintain the basket in a vertical position when the device is in operative position on a wheelchair. The device frees respiratory patients from confinement by providing them with available oxygen mounted on their wheelchairs.

3 Claims, 6 Drawing Figures

OXYGEN TANK HOLDER FOR WHEELCHAIRS

This invention relates to improvement in oxygen tank holding devices for attachment to most standard, foldable wheelchairs and is particularly directed to a collapsible device which, when mounted on a wheelchair, will be self-supporting and will center an oxygen tank thereon providing stability to the wheelchair both in its folded and operative positions.

It is an object of the invention to provide a detachable oxygen tank holder that centers the tank on most wheelchairs and which has collapsible features that will maintain the tank at all times in a centered position on standard, foldable wheelchair frames and also provide for compact storage of the holder when not in use.

Another object of the invention is to provide an oxygen tank holder having the foregoing characteristics which is rugged in structure and dependable in use and which will respond to the safety standards of hospital admitting and outpatient services handling patients suffering from respiratory difficulties, such as emphysema, or the like.

Other objects and features of the invention will become apparent from the following specification taken in conjunction with the accompanying drawings, wherein.

Figure 1:
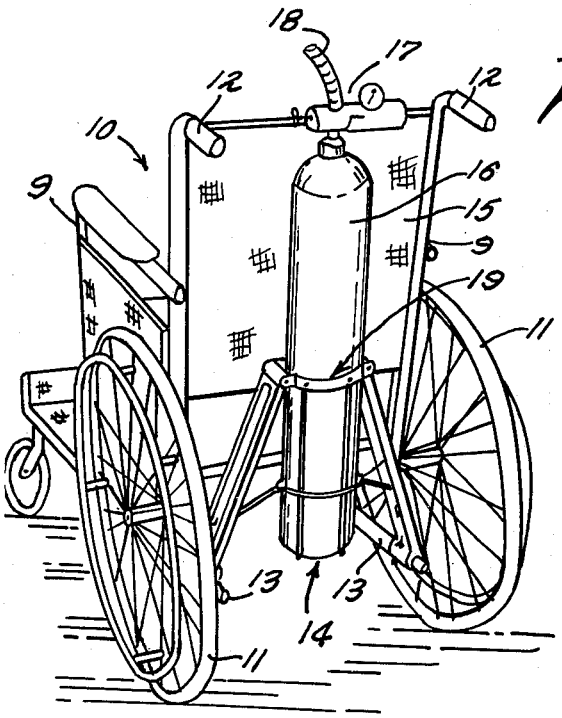
FIG. 1 is a perspective view of my oxygen tank holding device mounted in operative position on a foldable wheelchair.

With particular reference to FIG. 1 of the drawings, the numeral 10 indicates a standard wheelchair that has a pair of spaced side frames 9—9, each frame mounting a wheel 11 and each frame having a handle 12 and a foot lever 13 extending rearwardly therefrom, the frames being collapsible toward one another for ready storage and portability of the wheelchair. My oxygen tank holding device 14 is shown center mounted on the foot levers 13—13 behind the wheelchair seat 15 in position to support an upstanding oxygen tank 16 having a pressure control and guage unit 17 thereon, a tube 18 being led therefrom to a respirator (not shown) to administer oxygen to the occupant of the wheelchair.

The oxygen tank holding device 14 consists of a circular strap 19 having two opposed, semi-circular sections 20—20 each formed with a pair of end positioned ears 21—21 that are in horizontally spaced, confronting positions on the device. A pair of struts 22—22 of equal lengths depend from the strap on opposite sides thereof and each strut is provided with an upper boss 23 which is center bored and interposed between confronting ears 21—21 on each section of the strap. A pivot bolt 24 projects through the bore of each boss and through aligned holes formed in confronting ears 21—21 to provide a pivot bearing between each strut and the strap, the axes of the pivot bearings being disposed in parallelism on the strap.

Figure 2:
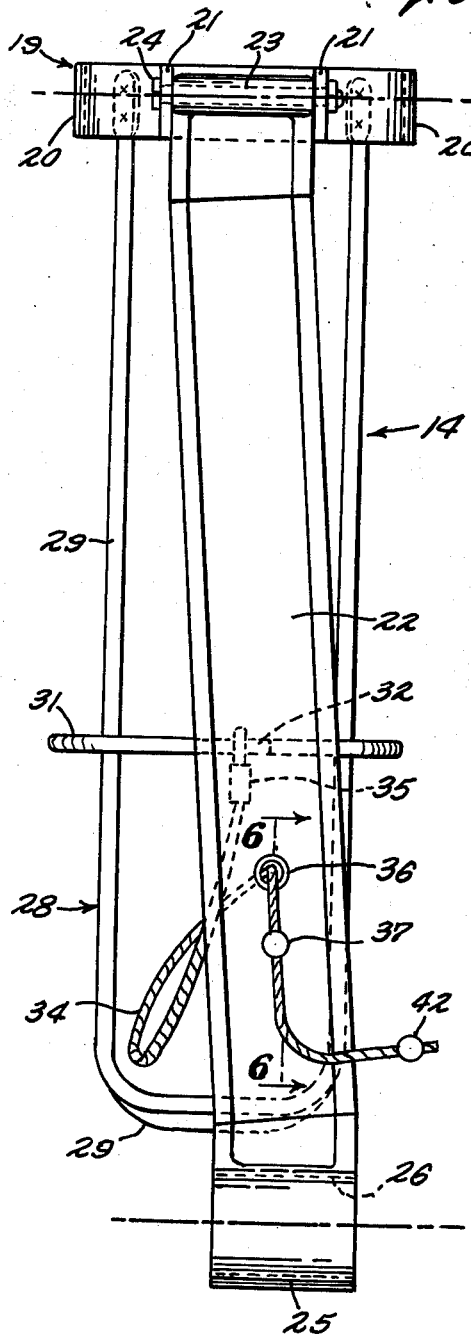
FIG. 2 is a side elevational view of the tank holding device in its collapsed, inoperative condition.
Figure 3:
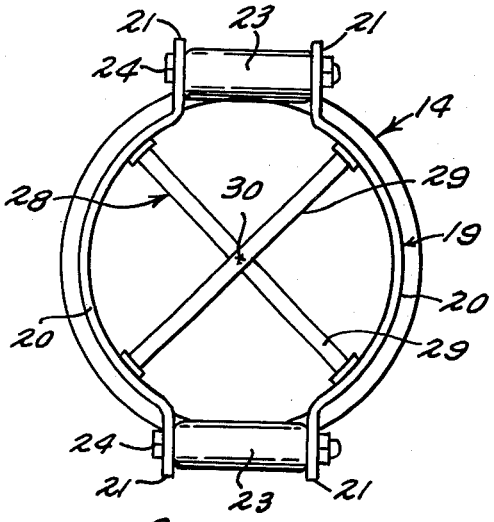
FIG. 3 is a top plan view of the tank holder shown in FIG. 2.
Figure 5:
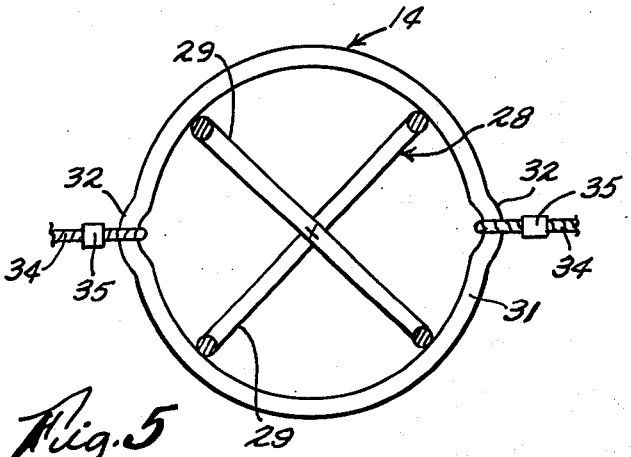
FIG. 5 is a section taken on line 5—5 of FIG. 4.
Figure 4:
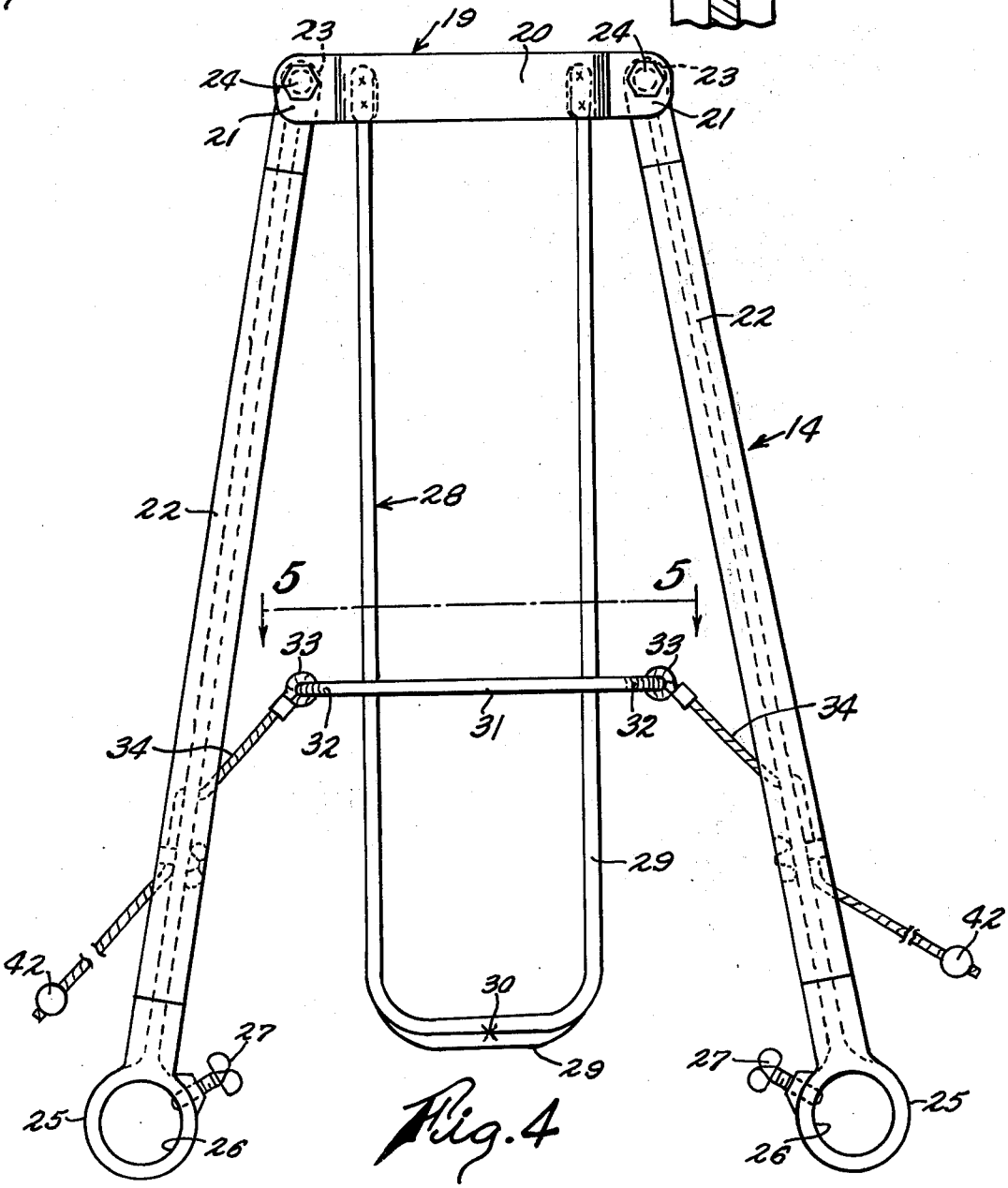
FIG. 4 is a front elevational view of my oxygen tank holding device in an inoperative, but extended condition to be mounted on a wheelchair.

The lower end of each strut 22—22 is provided with a sleeve bearing comprising a boss 25 having a bore 26 therethrough and each bore being adapted to slidably receive a foot lever 13 to mount the holding device on a wheelchair 10. As best shown in FIG. 2 of the drawings the axes of the bores 26—26 and the pivot bolts 24—24 are in parallelism on each strut 22. A thumb screw 27 (FIG. 4) is threaded in each boss 25—25 and securely clamps each strut to its foot lever.

An oxygen tank receiving basket 28 is hung from the strap 19 and comprises two U-shaped members 29—29 disposed at a 90° angle to each other and having their upper ends flattened and welded to the inside faces of the strap sections 20—20. The crossover portions of the members forming the bottom of the basket are welded together at 30.

Figure 6:
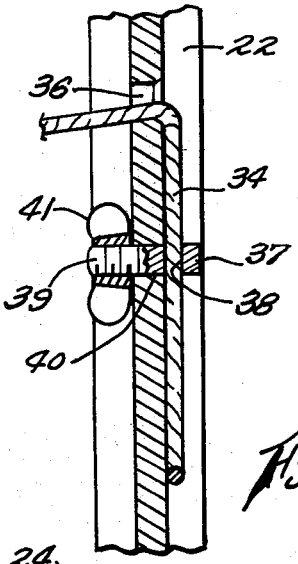
FIG. 6 is an enlarged section taken on line 6—6 of FIG. 2.

A ring member 31 encircles the mid-portion of the basket and is welded to the members 29—29, each side of the ring member being provided with an offset 32—32, and each offset engaging the looped, terminal end 33 of a flexible cable 34. The loops are formed by crimped sleeves 35. The free end of each cable 34 passes through a hole 36 formed through each strut and through a cable lock stud 37. As best shown in FIG. 6 of the drawings the stud 37 is of uniform diameter and has a lateral through hole 38 in one end to receive a cable portion and a threaded end 39 which freely passes through a hole 40 in the strut; a wing nut 41 being threaded onto the threaded end of the stud and engaging the strut. Each cable has a stop 42 fixed on its free end portion.

With reference to FIG. 2 of the drawings it will be noted that the axes of the pivot bolt 24 and the boss 25 on each strut 22 are in parallelism and are disposed at an angle of substantially 3° with the center line of the strut whereby when the holding device is mounted on a wheelchair 10 the oxygen tank 16 will be held in a spaced relation with the wheelchair's seat 15 to rovide clearance between the tank and the seat.

When not in use the oxygen tank holder 14 occupies a relatively small space for convenient transportation and compact storage, the struts 22—22 of the device being disposed in close proximity to the basket 28. The device is readily mounted on the foot levers 13—13 of most wheelchairs by merely removing the end caps, if any, from the levers and sliding the bosses 25—25 onto the foot levers and replacing the end caps. Thumb screws 27 are turned down onto the foot levers to insure a firm connection between the struts and the foot levers especially when a loose fit occurs between the levers and the bosses. When the wheelchair is in fully extended, operative position the basket 28 is placed in an upstanding, vertical position after which each cable 34 is pulled tightly through the hole 36 and cooperative lock stud 37 in each strut and the stud is then tightened down whereby the basket will be vertically held at all times in a central stable position on the wheelchair. It is then necessary only to insert the oxygen tank 16 into the basket. It will be noted that the oxygen holding device will collapse with collapse of the wheelchair whereby it can become portable with the wheelchair with or without an oxygen tank in the basket.

What is claimed is:

1. An oxygen tank holder for attachment to most foldable wheelchairs that have a pair of rearwardly extending foot levers, comprising a circular strap, a pair of depending struts of equal lengths, each having its upper end pivotally mounted on opposite sides of the strap, a sleeve bearing on the lower end of each strut adapted to detachably receive a foot lever of a wheelchair, a wire basket depending from the circular strap between the struts and adapted to receive the lower end portion of an oxygen tank, flexible cable means each connected to a mid-portion of the basket on opposite sides thereof, and an adjustable lock means on each strut and engagable with the terminal end portion of a flexible cable means.

2. An oxygen tank holder set forth in claim 1 wherein the circular strap has two opposed sections, end ears on each section disposed in spaced, confronting relation on each side of the strap, pivot means mounting the upper end of each strut between confronting ears, and the wire basket comprising a plurality of U-shaped members having their upper ends connected to the inside faces of the strap sections.

3. An oxygen tank holder set forth in claim 1 wherein the lock means comprises a hole formed in the strut through which the cable is threaded, and a stud spaced from the hole and having an aperture in one end to receive the cable, an opposed threaded end freely engaged in and projecting from a through hole formed in the strut, and a wing nut cooperative with the projected end of the stud.

* * * * *